US005170950A

United States Patent [19]

Okitsu et al.

[11] Patent Number: 5,170,950

[45] Date of Patent: Dec. 15, 1992

[54] FEEDING DEVICE

[75] Inventors: Motoaki Okitsu, Yamatokoriyama; Yuji Sugimoto; Kenichi Iwamoto, both of Nara, all of Japan

[73] Assignee: Sharp Kabushiki Kaisha, Osaka, Japan

[21] Appl. No.: 781,674

[22] Filed: Oct. 24, 1991

Related U.S. Application Data

[63] Continuation of Ser. No. 521,834, May 10, 1990, abandoned.

[30] Foreign Application Priority Data

May 15, 1989 [JP] Japan ..... 1-121812

[51] Int. Cl.[5] ..... B65H 1/08

[52] U.S. Cl. ..... 271/127; 271/157; 271/162

[58] Field of Search ..... 271/127, 145, 147, 157, 271/162, 164, 171, 241, 253-255

[56] References Cited

U.S. PATENT DOCUMENTS

| | | | |
|---|---|---|---|
| 4,516,764 | 5/1985 | Tamura | 271/127 X |
| 4,535,982 | 8/1985 | Mochimaru | 271/157 X |
| 4,582,314 | 4/1986 | Yamamoto et al. | 271/127 |
| 4,763,891 | 8/1988 | Kodama | 271/157 |
| 4,793,606 | 12/1988 | Yasouka et al. | 271/127 X |
| 4,896,871 | 1/1990 | Idenawa | 271/127 X |
| 5,002,266 | 3/1991 | Kikuchi et al. | 271/127 X |

FOREIGN PATENT DOCUMENTS

| | | | |
|---|---|---|---|
| 3403456 | 8/1984 | Fed. Rep. of Germany . | |
| 3431812 | 3/1986 | Fed. Rep. of Germany . | |
| 93743 | 7/1980 | Japan | 271/127 |
| 56-59245 | 5/1981 | Japan . | |
| 56-59251 | 5/1981 | Japan . | |
| 70240 | 6/1981 | Japan | 271/157 |
| 262735 | 12/1985 | Japan | 271/195 |
| 111830 | 5/1987 | Japan | 271/127 |
| 140936 | 6/1987 | Japan | 271/127 |

*Primary Examiner*—Robert P. Olszewski
*Assistant Examiner*—Boris Milef
*Attorney, Agent, or Firm*—Birch, Stewart, Kolasch & Birch

[57] ABSTRACT

A feeding device including a cassette removably mounted in the main body of a copying machine to which the feeding device is adapted, a pivotal paper holding plate which is disposed within the cassette and capable of being raised, a lift member for raising the pivotal paper holding plate to an inclined dispensing position, disposed under the pivotal paper holding plate so as to pivot on a vertical plane, a rotary lift-up member for allowing the lift member to pivot thereon, the lift member being secured to the rotary lift-up member, a driving device for transmitting a driving force to the rotary lift-up member, a coupling device interposed in the driving device, for effecting and suspending the transmission of the driving force for rotating the rotary lift-up member, wherein when the cassette is taken out from the main body, the lift member pivots downward due to its own weight, thereby releasing the pivotal paper holding plate from its raised condition. With such an arrangement, even if the cassette is taken out from the main body when the pivotal paper holding plate is in its raised condition, the paper feeding end of the pivotal paper holding plate can be prevented from touching with the paper feed mechanism disposed within the main body, thereby avoiding damage to the contacted parts.

14 Claims, 10 Drawing Sheets

FEEDING DEVICE

This application is a continuation of application Ser. No. 07/521,834 filed on May 10, 1990, now abandoned.

FIELD OF THE INVENTION

The present invention relates to a feeding device for an apparatus such as a copying machine, a laser printer, and an overhead projector, the feeding device being capable of feeding copy material laterally or longitudinally oriented with respect to a feeding direction. More particularly, the invention relates to a feeding device that has a pivotal copy material holding plate for lifting up copy material, the holding plate being lowered when a copy material storing unit of the feeding device is removed from the main body of the apparatus.

BACKGROUND OF THE INVENTION

There are conventionally known copying machines provided, under the main body thereof, with a desk for accommodating several paper feed cassettes in tiers. Those copying machines are capable of storing copy papers of various sizes in the cassettes, feeding laterally or longitudinally oriented paper, and automatically selecting paper to be fed, thereby reducing the operation required for changing papers to be used (see Japanese Patent Publication Laid-Open No. 192637/1986 (Tokukaisho 61-192637)).

In such an apparatus, it is essential that a top sheet in a stack of copy papers stored in the cassette be lifted up until it comes in contact with a pick-up roller, in order to be picked up and sent out by the pick-up roller. Several approaches to meet the above requirement have been provided. For example, Japanese Patent Publication Laid-Open No. 59245/1981 (Tokukaisho 56-59245) and Japanese Patent Publication Laid-Open No. 59251/1981 (Tokukaisho 56-59251) disclose a paper feed cassette having a paper holding plate that is pivotally disposed for lifting up paper and a lever for raising the paper feeding end of the holding plate.

However, when the above arrangement is employed in a copying machine having a cassette that can be mounted in and removed from the main body of the copying machine for supplying paper in the cassette or setting a paper jam, if the cassette is taken out from the main body with the pivotal paper holding plate being raised, the paper feeding end of the holding plate touches with the feeding mechanism provided in the main body, resulting in damage to both holding plate and feeding mechanism.

SUMMARY OF THE INVENTION

The present invention provides a feeding device in which the feeding end of a copy material feed unit is prevented from contacting the copy material feeding mechanism provided within the main body of the apparatus to which the feeding device is adapted, when the copy material feed unit is removed from the main body for supplying paper or settling a jam.

In order to achieve the above object, the feeding device of the present invention comprises:

(1) a copy material feed unit that is capable of being mounted in and removed from the main body of an apparatus to which the feeding device is adapted, and has a pivotal copy material holding plate for stacking copy materials thereon which can be raised;

(2) driving means for transmitting a driving force for raising the copy material holding plate until the copy materials stacked thereon come in contact with the feeding mechanism disposed within the main body of the apparatus; and (3) means for arresting the driving force in cooperation with the removal of the copy material feed unit from the main body of the apparatus, thereby suspending the transmission of the driving force to the pivotal copy material holding plate in order to release the holding plate from its raised condition.

With such an arrangement, even if the copy material feed unit is removed from the main body of the apparatus for supplying copy paper or settling a jam when the pivotal copy material holding plate is in a raised condition, the paper feeding end of the holding plate can be prevented from contacting the feeding mechanism disposed within the main body so that damage to the contacted parts can be avoided, since the holding plate is released from its raised condition in cooperation with the removal of the copy material feed unit from the main body.

The invention and its various advantages will become more apparent to those skilled in the art from the following detailed description of preferred embodiments, reference being made to the accompanying drawings.

BRIEF DESCRIPTION OF THE DRAWINGS

FIG. 1 is a perspective view showing a rotatable cassette;

FIG. 2 is a plan view showing the rotatable cassette in which coupling parts of a first coupling and a second coupling are disengaged when the rotatable cassette is removed;

FIG. 3 is a schematic front view of a copying machine showing the internal structure thereof;

FIG. 4 is a plan view of a feeding mechanism;

FIG. 5(*a*) is a side view of the feeding mechanism;

FIG. 5(*b*) is a side view of the feeding mechanism wherein a paper pushing back member is actuated;

FIGS. 6(*a*) through 6(*d*) are a plan view of the rotatable cassette, respectively, showing the rotation of the rotatable cassette.

DESCRIPTION OF THE EMBODIMENTS

Referring now to FIGS. 1 through 6, one embodiment of the present invention will be described below.

Figure 3:
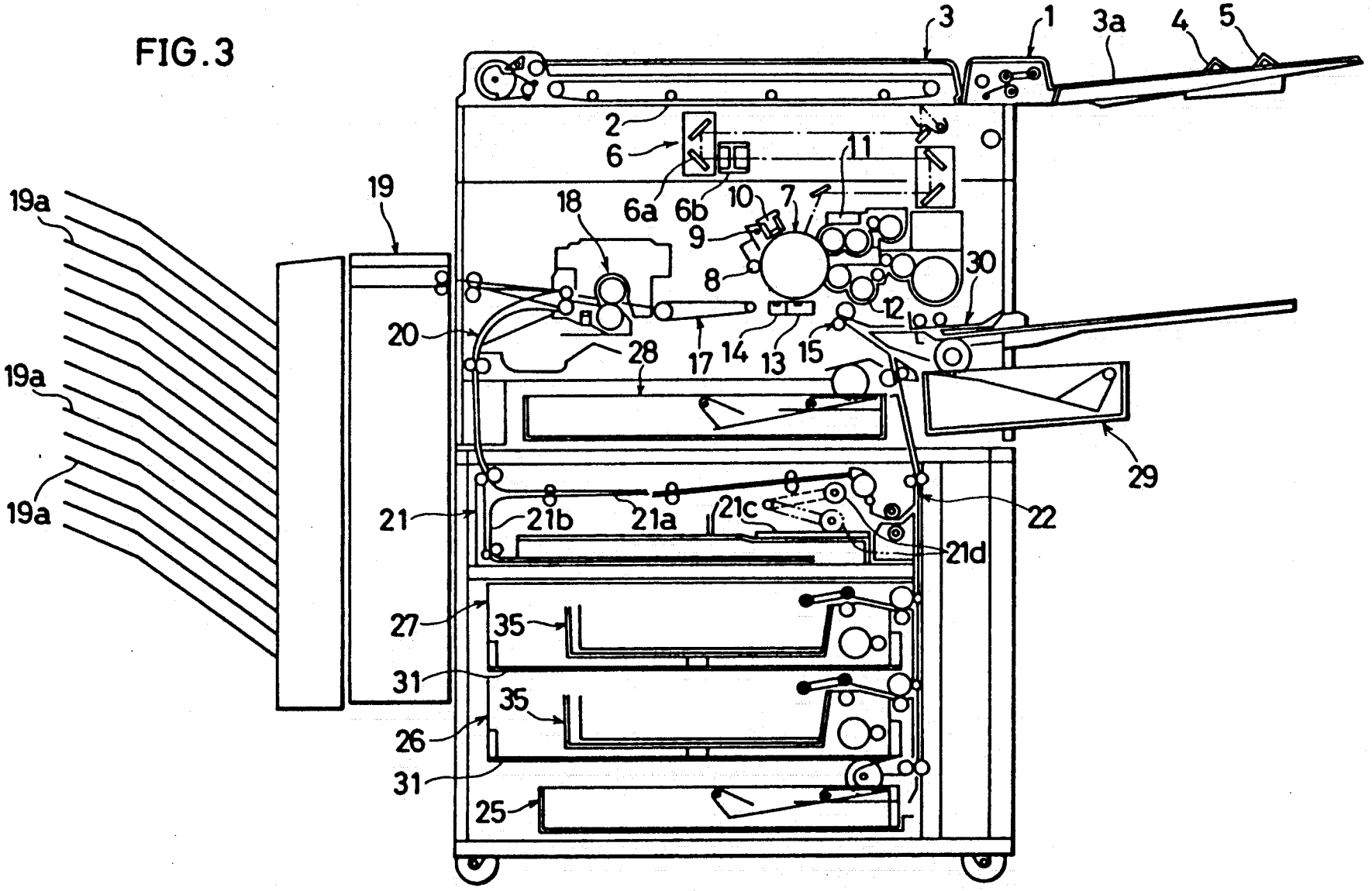

As shown in FIG. 3, a document glass plate 2 of a copying machine 1 is provided with an automatic document feeder 3 (hereinafter referred to as "ADF"). The ADF 3 conveys a document (not shown) from a document tray 3*a* to a position on the document glass plate 2, the position being predetermined in accordance with the size and orientation ("lateral orientation" or "longitudinal orientation" with respect to a paper feed direction) of the document, and ejects the document outward after completion of the copying operation. In the case of a duplex copying operation, the ADF 3 turns the document over, one face of which has been copied, conveys it onto the predetermined position on the document glass plate 2 again and ejects it outward after both faces are copied. The document tray 3*a* is provided with detection switches 4 and 5 for detecting the size of a document placed on the document tray 3*a*.

Under the document glass plate 2 is provided an optical system 6 comprising a plurality of reflection mirrors 6a and a plurality of lenses 6b. The optical system 6 basically functions to guide the optical image of a document onto a photosensitive drum 7 and has a function of varying magnification in order to perform magnified copying and reduced size copying, in addition to real-size copying.

Around the photosensitive drum 7 are disposed a cleaner 8, a static eliminating charger 9, a main charger 10, a developing device 11 in which toners for full color copying are stored, and a developing device 12 in which black toner is stored. With those members, a series of operations, that is, the removal of residual toner from the photosensitive drum 7, static elimination, electrification, exposure (performed by the optical system 6), and development are performed in this order.

There are provided a transferring charger 13, and a separating charger 14 under the photosensitive drum 7. When a copy paper (copy material), not shown in the drawing, passes between the photosensitive drum 7 and the transferring charger 13, a toner image formed on the photosensitive drum 7 is transferred onto the paper by the transferring charger 13. The paper is then separated from the photosensitive drum 7 by the separating charger 14 and conveyed by a conveyor belt 17 to a fixing device 18 which fixes the toner on the paper by heating or pressurizing.

After passing through the fixing device 18, the paper is ejected outside the main copy machine 1, that is, discharged onto one of a plurality of paper receiving trays 19a via the sorter 19. When duplex copying or composite copying is performed, the paper that has passed through the fixing device 18 passes through a paper return path 20 and is guided to a duplex/composite unit 21. In the case of duplex copying, the paper is turned over and placed on an intermediate tray 21c after passing through a first delivery path 21a within the duplex/composite unit 21. The paper then is sent out to a paper feed path 22 by a forwarding roller 21d. In the case of composite copying, the paper that has been guided to the duplex/composite unit 21 is sent to a second delivery path 21b within the unit 21 and after the trailing edge of the paper is detected thereat, the paper returns and is backwardly guided to the first delivery path 21a. Thereafter, the paper is turned over so as to be placed on the intermediate tray 21c, and then sent out by the forwarding roller 21d to the paper feed path 22.

The paper feed path 22 is a path for guiding a copy paper to the photosensitive drum 7 and is provided, at the forward end thereof, with a paper stop roller 15 for determining timing for rotating the photosensitive drum 7 and sending out of a paper. The paper feed path 22 is connected to a plurality of paper feed means from which copy paper is appropriately fed. More concretely, in an ascending scale, there are installed in the copying machine a first fixed cassette 25, a first rotatable cassette 26, a second rotatable cassette 27, the duplex/composite unit 21, a second fixed cassette 28, a third fixed cassette 29, and a manual paper feeder 30. The first fixed cassette 25, the second fixed cassette 28 and the third fixed cassette 26 (these cassettes are copy material feed units) are respectively detachable from the copying machine 1. The first rotatable cassette 26 and the second rotatable cassette 27 (these cassettes are copy material feed units) are detached together with their bed-plates 31 from the copying machine 1.

Figure 1:
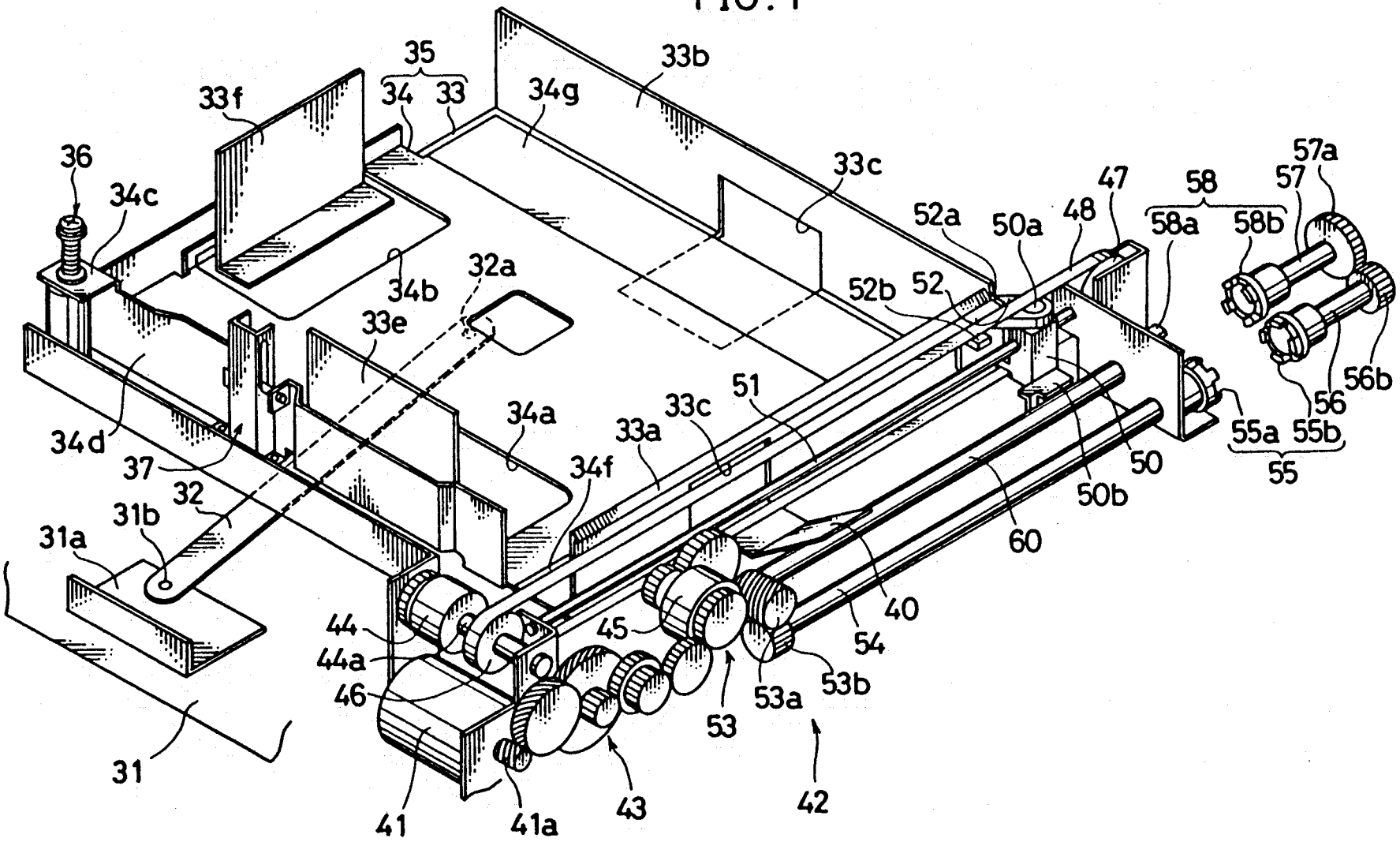
FIGS. 1 through 6 show one preferred embodiment of the present invention.

As shown in FIG. 1, the first and second rotatable cassettes 26 and 27 are respectively provided with the bed-plate 31 which is a housing for the cassette, having a washer 31a secured thereto. At the washer 31a, a pivot pin 31b is vertically disposed. One end of an arm 32 is supported by the pivot pin 31b such that the arm 32 horizontally pivots on the pivot pin 31b. At the other end of the arm 32, there is vertically disposed a pivot pin 32a by which a rotating section 35 (copy material orientation changing means) is pivotally supported. The rotating section 35 has a two-sheet structure, comprising a paper feed base 33 (copy material feed base) and a pivotal paper holding plate 34 (pivotal copy material holding plate) positioned on the paper feed base 33. The rotating section 35 turns through 90° thereby conveying copy papers stacked on the pivotal paper holding plate 34 to a position from which paper laterally oriented with respect to a feed direction is fed (the position is hereinafter referred to as "lateral feed position") or a position from which paper longitudinally oriented with respect to the same is fed (the position is hereinafter referred to as "longitudinal feed position"). The position at which one end of the arm 32 is pivotally supported by the pivot pin 31b is so determined that when the stack of papers are rotatively conveyed to the lateral feed position or longitudinal feed position, the center of the papers is always located on the pivot pin 32a.

The paper feed base 33 is provided with wall portions 33a, 33b, 33f and 33e. The wall portions 33a, 33f and 33e define, together with the pivotal paper holding plate 34, a paper stacking position for lateral feed (lateral copy material stacking position), and function to prevent a stack of copy papers from shifting from the above position when the papers are laterally fed. On the other hand, the wall portions 33b, 33e and 33f define, together with the pivotal paper holding plate 34, a paper stacking position for longitudinal feed (longitudinal copy material stacking position), and prevent stacked papers shifting from the above position when they are longitudinally fed. The wall portions 33a and 33b are integrally formed with the paper feed base 33, vertically raising therefrom. Each of the wall portions 33a and 33b is provided with an opening 33c at the substantially central part thereof. The opening 33c turns, extending a predetermined distance toward the center of the paper feed base 33. When the rotating section 35 is set in either of the feed positions, a lift member 40 is located beneath the opening 33c and when the lift member 40 is pivoted upward in this condition, the lift member 40 can be brought into contact with the bottom face of the pivotal paper holding plate 34, passing through the opening 33c. The structure of the lift member 40 will be later described in detail.

The wall portions 33f and 33e are secured to the upper face of the paper feed base 33, facing toward the wall portions 33a and 33b respectively. The wall portion 33f raises passing through an opening 34b and the wall portion 33e raises passing through an opening 34a, these openings 34a and 34b being provided for the pivotal paper holding plate 34. Therefore, the wall portions 33f and 33e do not interfere with the raising movement of the pivotal paper holding plate 34.

The pivotal paper holding plate 34 is provided with inclined parts 34f and 34g which respectively bend forwardly. When the holding plate 34 is raised by the lift member 40 for longitudinal feed, the inclined part 34f makes an optimum tilt angle for feeding paper to the main body of the copying machine 1. Similarly, when the holding plate 34 is raised for lateral feed, the inclined part 34g makes an optimum tilt angle. At one corner of the pivotal paper holding plate 34, there is provided a supporting segment 34c outwardly bending from the upper end of the wall portion 34d. At that corner, the trailing end of paper comes in contact in both cases with paper which is placed in the paper stacking position for lateral feed and the paper stacking position for longitudinal feed. The supporting segment 34c is provided with a supporting member 36 for supporting the pivotal paper holding plate 34 at one point.

A guide means 37 is disposed at a predetermined distance from the supporting member 36 in the feed direction for longitudinal feed. The guide means 37 guides the pivotal paper holding plate 34 when the holding plate 34 is raised for longitudinal feed, and functions as a supporting point on which the holding plate 34 pivots when it is raised for lateral feed.

The rotatable cassettes 26 and 27 are respectively provided, at the paper feeding end thereof with which the leading edge of copy paper comes in contact, with a driving means 42 comprising a driving motor 41 for turning the rotating section 35 through 90° as well as turning the lift member 40 in order to lift up a stack of papers on the pivotal paper holding plate 34. In the driving means 42, a gear 41a is secured to the driving shaft of the driving motor 41. The gear 41a is in mesh with a group of gears 43 through which the driving force of the driving motor 41 is transmitted to a first clutch 44 and a second clutch 45.

Figure 2:
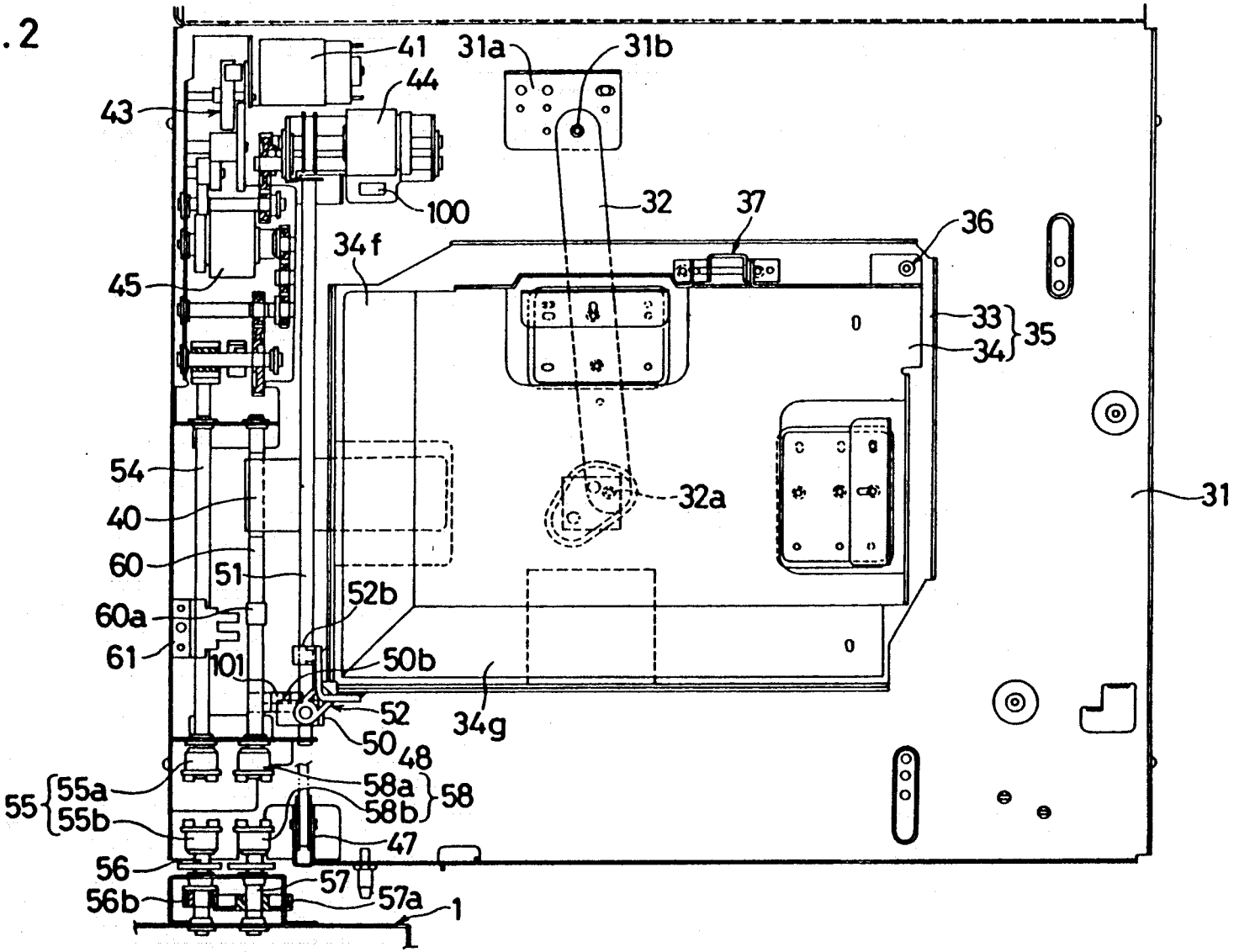

The first clutch 44 is disposed at the side of the paper feeding end of the rotating section 35 in order to suspend and execute the transmission of the driving force utilized for turning the rotating section 35 through 90°. The first clutch 44 has a driving shaft 44a to which a pulley 46 is secured. The other side of the paper feeding end of the rotating section 35 is provided with a pulley 47, and an endless belt 48 passes around these pulleys 46 and 47. The lower part of the belt 48, which passes under the pulleys 46 and 47 is provided with a moving block 50 secured to a predetermined position thereof such that the moving block 50 reciprocates as the belt 48 moves. At the substantially central part of the moving block 50 is provided a through-hole through which a guide shaft 51 passes. The guide shaft 51, by which the moving block 50 is linearly guided, is disposed between the pulleys 46 and 47 in a direction orthogonal to the feed direction. On the moving block 50 is provided a pivot pin 50a by which a holding member 52 is pivotally supported. A substantially L-shaped angle section 52a provided for the holding member 52 is attached to one corner of the rotating section 33 at which the wall portion 33a comes in contact with the wall portion 33b. As shown in FIG. 2, in the vicinity of one end of the guide shaft 51, a position detection switch 100 is provided, while a position detection switch 101 is provided in the vicinity of the other end thereof. The position detection switch 100 is switched on by a switch actuating segment 52b secured to the angle section 52a and the position detection switch 101 by an actuating segment 50b secured to the moving block 50.

The second clutch 45 effects and suspends the transmission of the driving force for lifting up copy papers stacked on the rotating section 34 and the output force of the second clutch 45 is transmitted to the rotary shaft 54 via the group of gears 53. More specifically, the output force of the second clutch 45 is transmitted to the rotary shaft 54 disposed in a direction perpendicular to the driving shaft of the second clutch 45, via the group of gears 53, a worm gear 53a and a wheel gear 53b which meshes with a worm gear 53a.

At the other end of the rotary shaft 54, there is secured a coupling part 55a which is one component of a first coupling 55 (coupling means). At the end of a rotary shaft 56 rotatably supported at the main body of the copying machine 1 is secured a coupling part 55b which is the other component of the first coupling 55. A gear 56b secured to the rotary shaft 56 is in mesh with a gear 57a secured to a rotary shaft 57. Likewise, the rotary shaft 57 juxtaposed with the rotary shaft 56 is pivotally supported by the main body of the copying machine 1. At the end of the rotary shaft 57, a coupling part 58b which is one component of a second coupling 58 (coupling means) is secured. A coupling part 58a, which is the other component of the second coupling 58, is secured to one end of the lift-up shaft 60 (rotary lift-up member). The lift-up shaft 60 is in parallel with the rotary shaft 54 and the substantially central part thereof is provided with a lift member 40 secured thereto. This lift member 40 is pivoted by the rotation of the lift-up shaft 60, thereby raising the paper feeding end of the pivotal paper holding plate 34. The other end of the lift-up shaft 60 is just pivotally held without any member connected thereto. The lift-up shaft 60 is provided with a switch actuating segment 60a (shown in FIG. 2) secured thereto and there is provided with a lift detection switch 61 in the vicinity of the switch actuating segment 60a, the lift detection switch 61 being switched ON and OFF by the pivot of the switch actuating segment 60a. Whether the pivotal paper holding plate 34 is raised or not is detected by the turning of the lift detection switch 61.

A driving force is transmitted to the lift member 40 by means of the group of gears 53, the rotary shaft 54, the first coupling 55, the rotary shafts 56 and 57, the second coupling 58 and the lift-up shaft 60. The coupling means, by which the driving force is cut off in cooperation with the removal of the rotatable cassette 26 or 27, is made up of the first coupling 55 and the second coupling 58. The lift-up shaft 60 functions as the rotary lift-up member for releasing the pivotal paper holding plate 34 from its raised condition. More concretely, the lift-up shaft 60 is lowered by the disengagement of the coupling means and the lift member 40 secured to the lift-up shaft 60 becomes free and pivots downward because of its own weight, thereby releasing the holding plate 34 from its raised condition. Each of the coupling parts 55b and 58b is resiliently supported by a spring coil (not shown) in the axial direction. Therefore, a shock generated at the time of the engagement of the coupling parts 55a and 55b and that of the coupling parts 58a and 58b is absorbed and the coupling condition is ensured.

Figure 4:
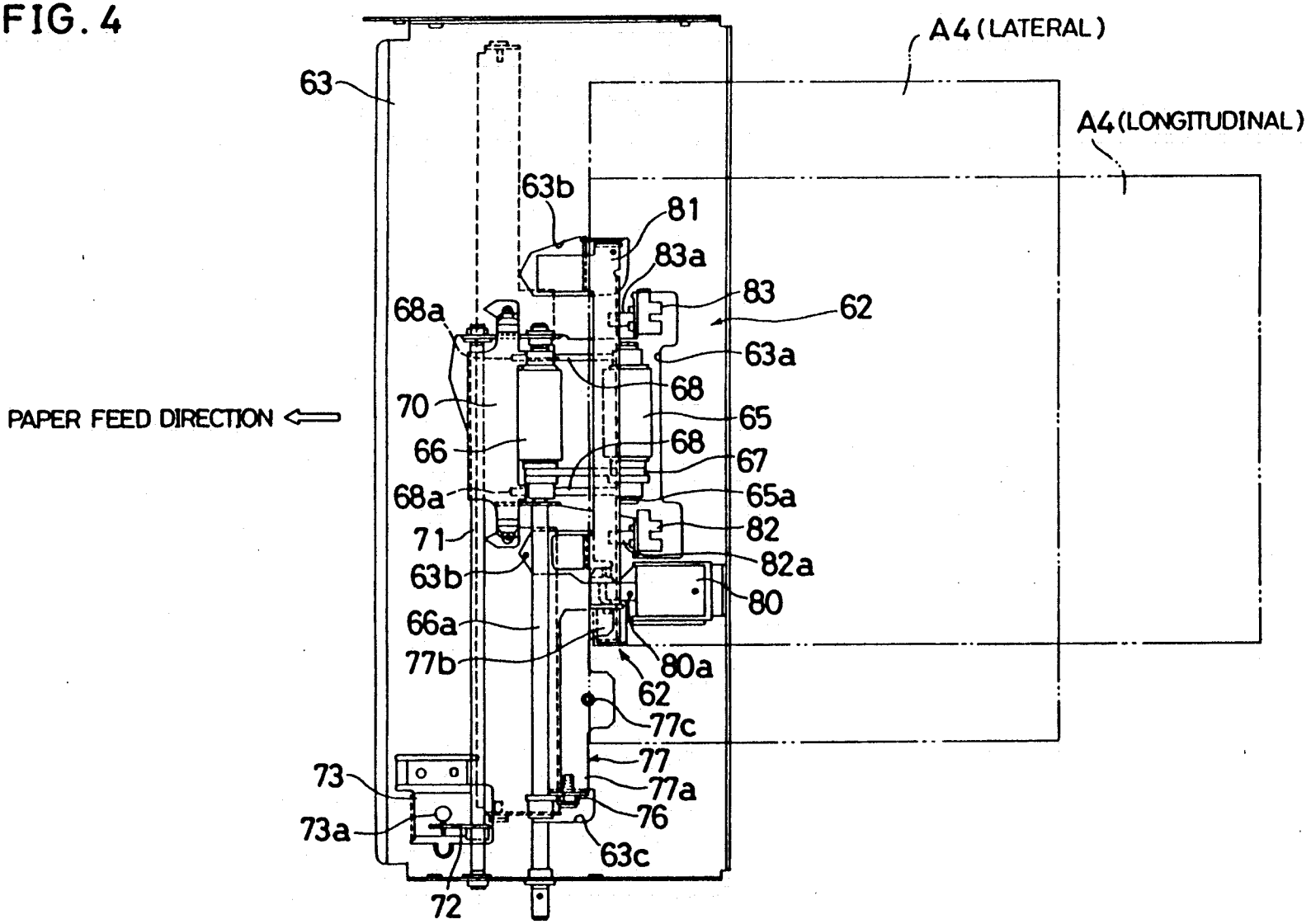

As shown in FIG. 4, there is provided a supporting board 63 above the paper feeding end of the rotating section 35, being secured to the main body of the copying machine 1. On the supporting board 63, there is provided a paper feed mechanism 62 for delivering copy paper to the paper feed path 22. The supporting board 63 is provided with openings 63a, 63b and 63c. The opening 63a allows a part of a pick-up roller 65 disposed in the paper feed mechanism 62 and a part of a paper feed roller 66 to respectively project downward from the supporting board 63. The opening 63b allows a part of a paper pushing back member 81 to project downward from the supporting board 63 and the opening 63c allows a part of a pressure contact releasing lever 76 to project downward from the same.

In the paper feed mechanism 62, the pick-up roller 65 is positioned above the paper feeding end of the rotating section 35, and the paper feed roller 66 is juxtaposed with the pick-up roller 65, being at a predetermined distance therefrom in the feed direction. An endless belt 67 passes around each of these feed direction. An endless belt 67 passes around each of these rollers 65 and 66 at one end, whereby the rollers 65 and 66 are rotated in the same direction. A pair of roller arms 68 stretch between a supporting shaft 65*a* for rotatably supporting the pick-up roller 65 and the rotary shaft 66*a* for transmitting the driving force to the paper feed roller 66, with these rollers 65 and 66 between the supporting shaft 65*a* and the rotary shaft 66*a*. The pick-up roller 65 goes up and down as the pair of roller arms 68 rotate on the rotary shaft 66*a*, whereby the pick-up roller 65 comes in contact with or is separated from the copy paper.

Each of the roller arms 68 is provided with a projection part 68*a* at one end close to the paper feed roller 66. The projection parts 68*a* are pressed downward by a paper feed operation angle 70 so that the roller arms 68 pivot upward. The paper feed operation angle 70 is secured to one end of a paper feed operation shaft 71 and pivots as the paper feed operation shaft 71 rotates.

A solenoid connecting plate 72 is secured at the other end of the paper feed operation shaft 71. At the end of the solenoid connecting plate 72, there is formed an elongated hole with which an operation shaft 73*a* of a paper feed solenoid 73 is coupled. The upward/downward movements of the operation shaft 73*a* are converted to the rotating movement of the paper feed operation shaft 71 via the solenoid connecting plate 72.

Figure 5A:
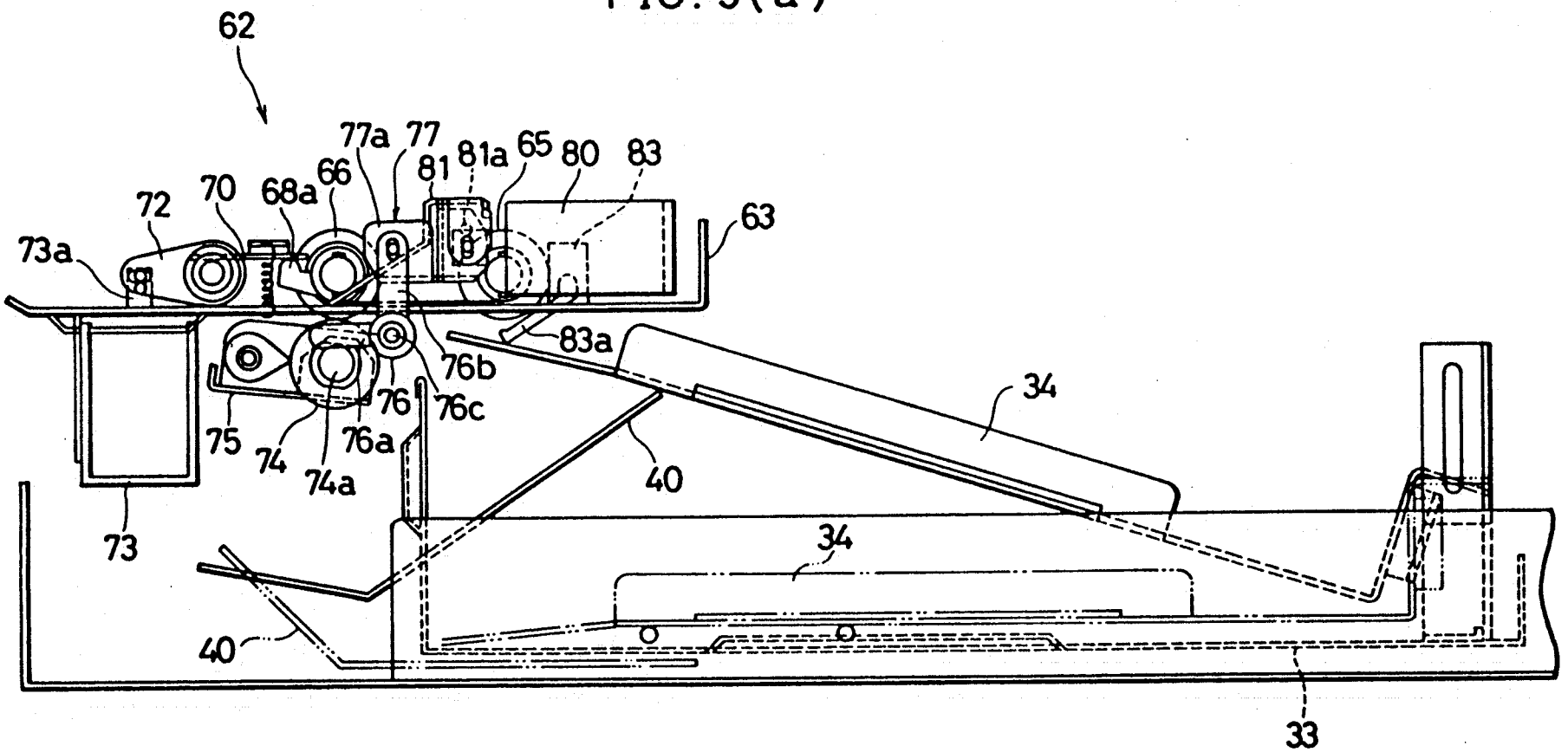
Figure 5B:
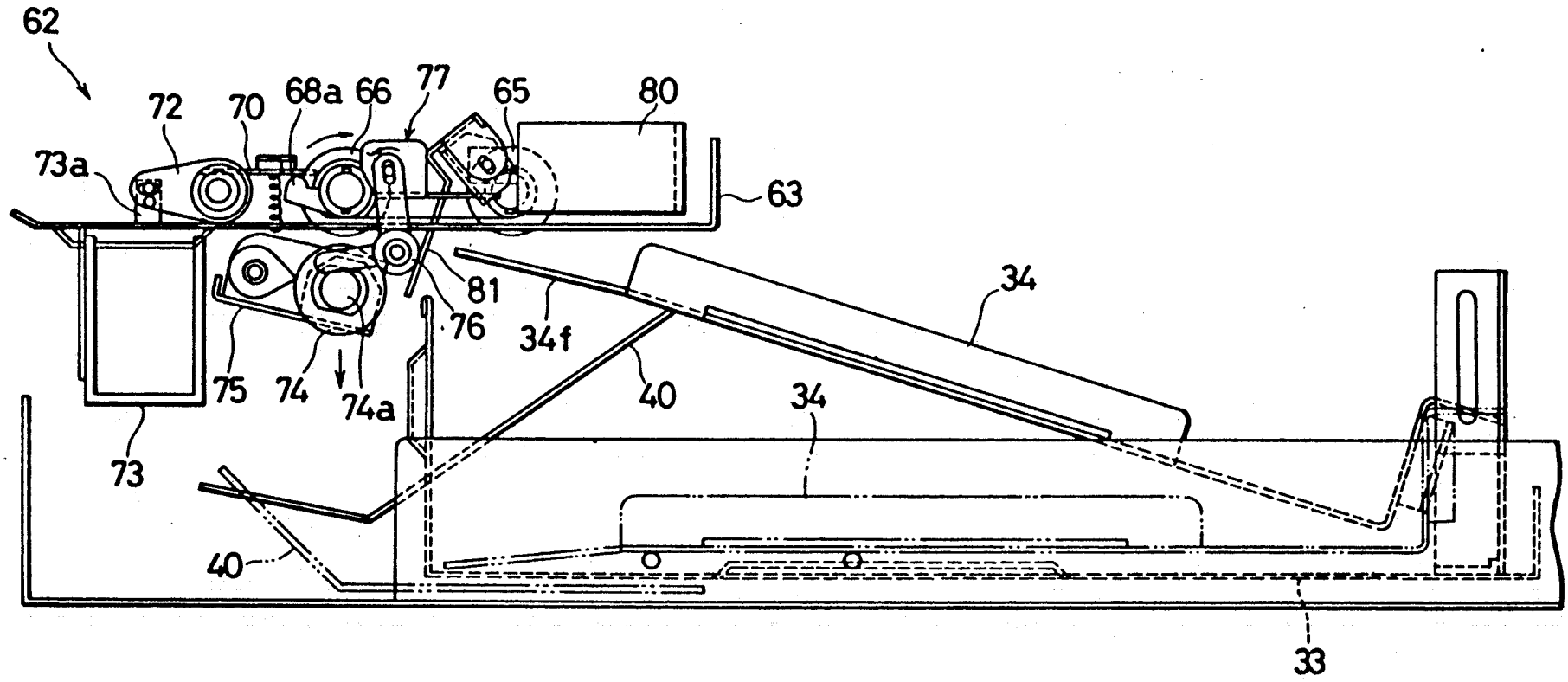
Figure 6A:
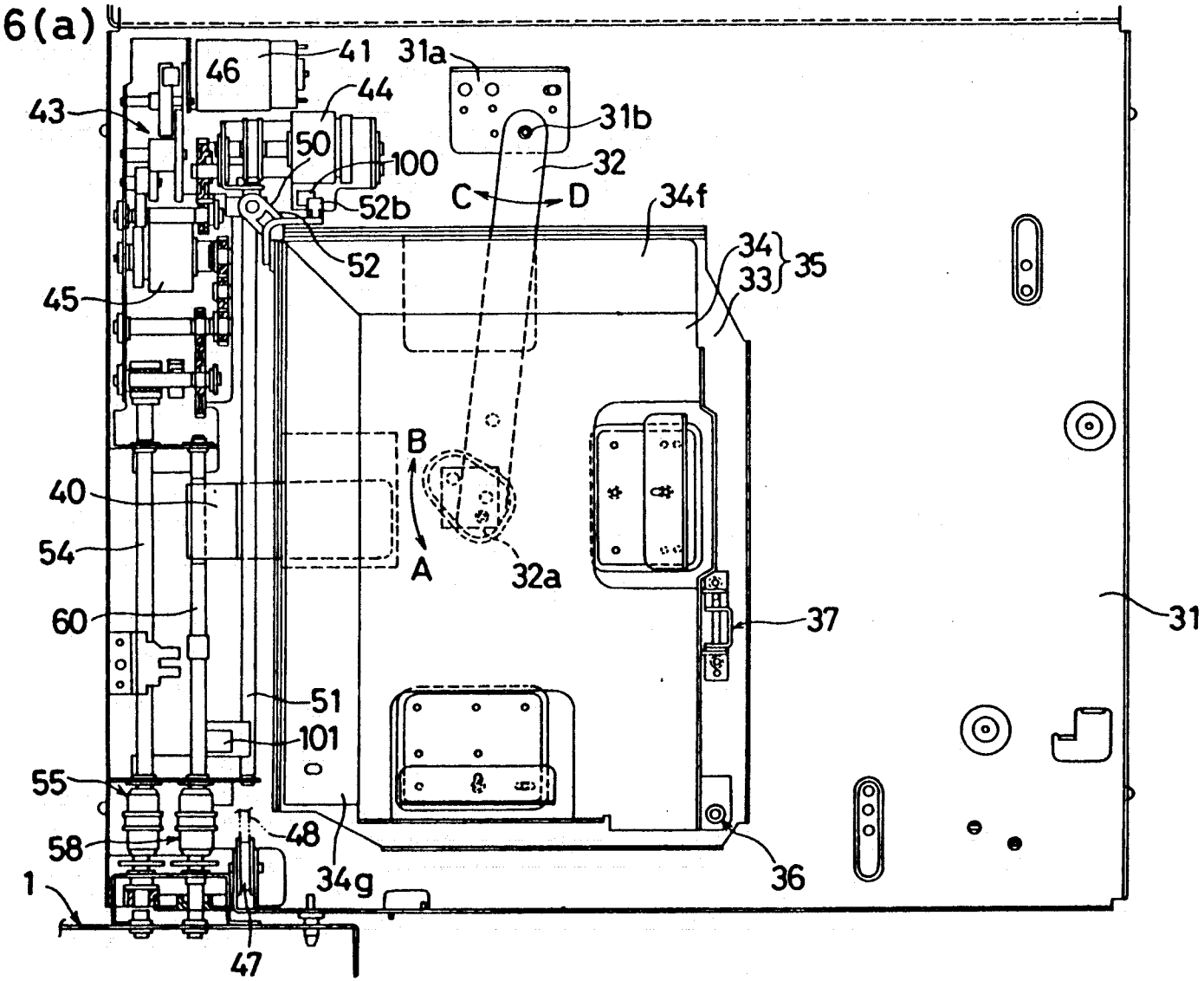
Figure 6B:
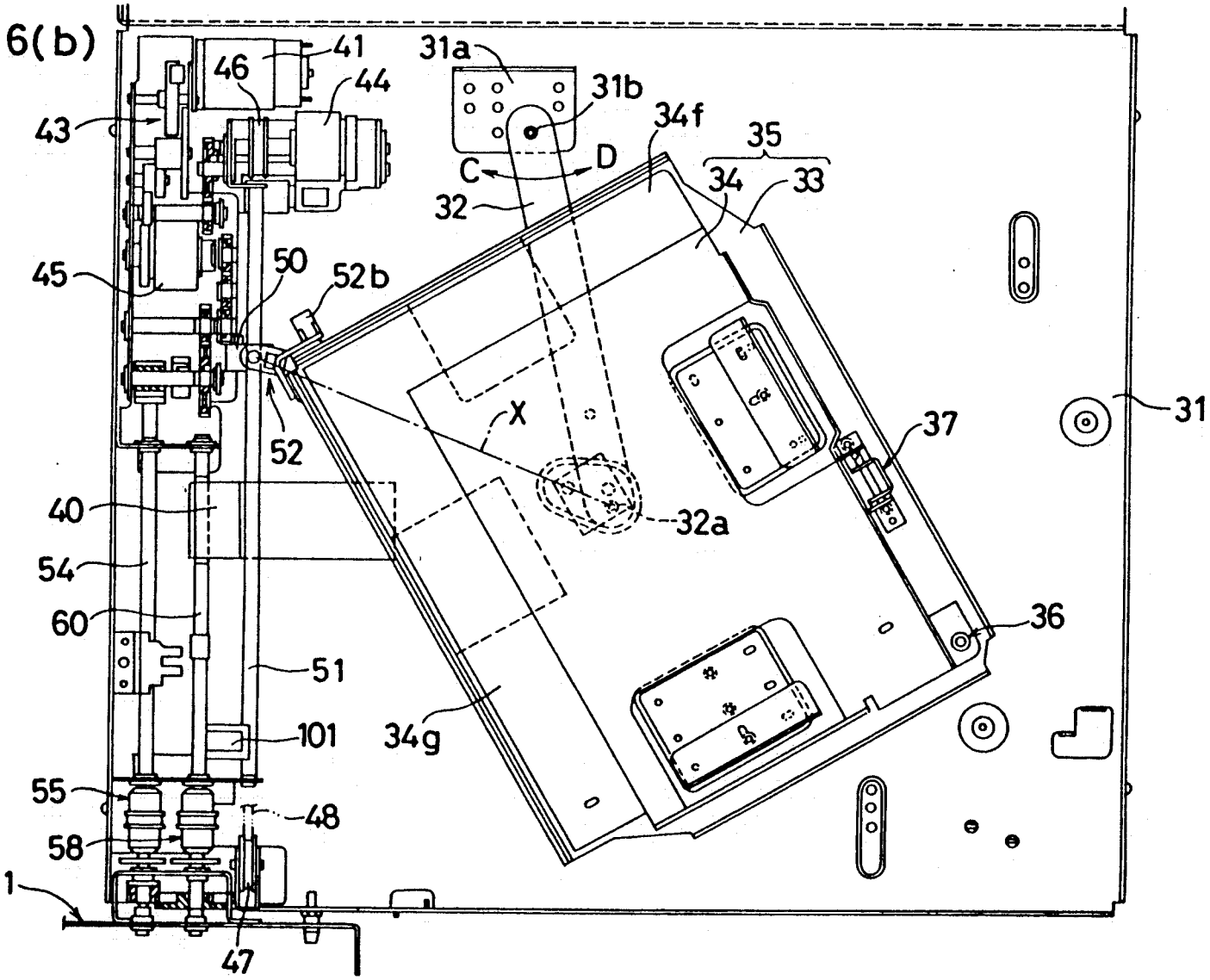
Figure 6C:
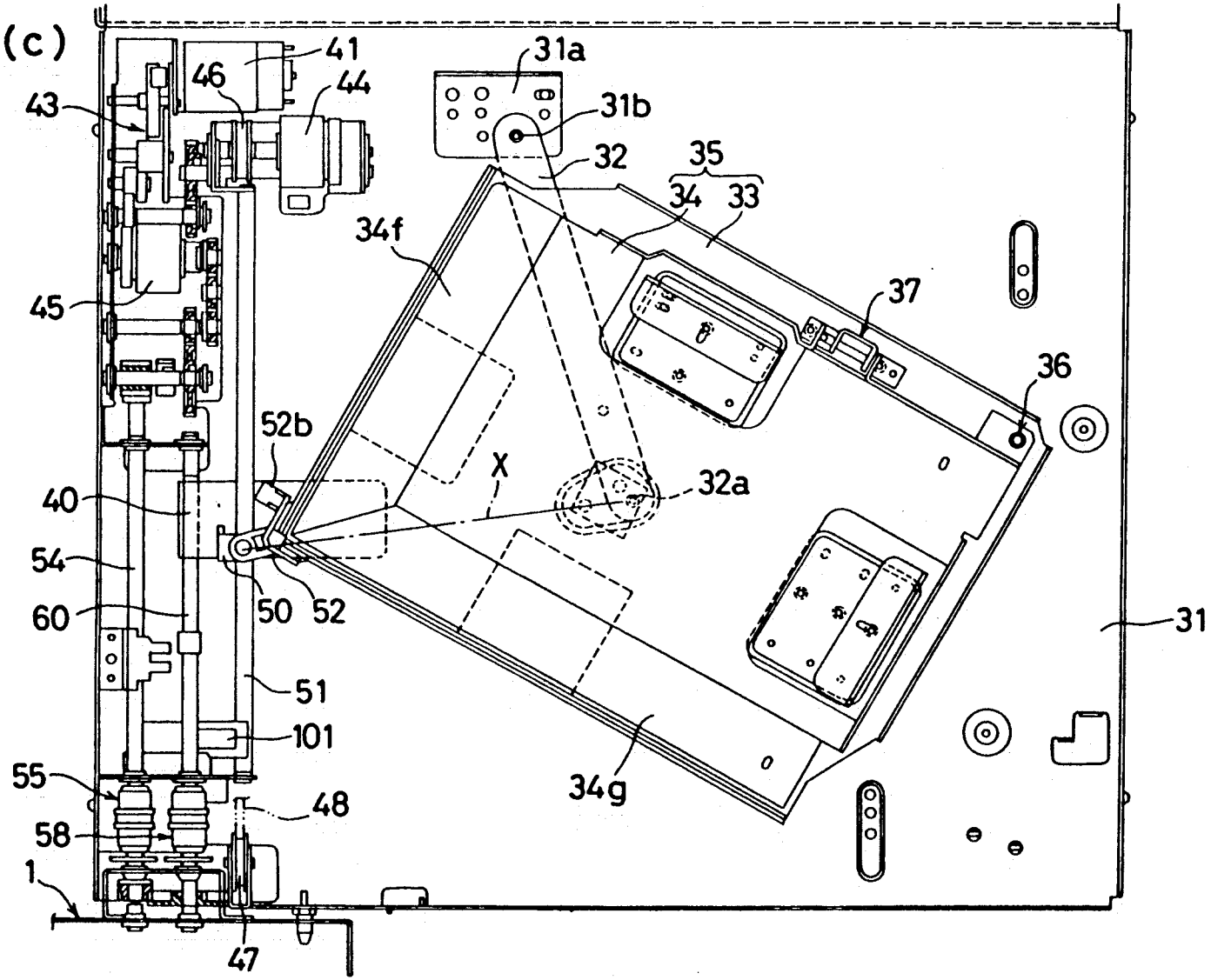
Figure 6D:
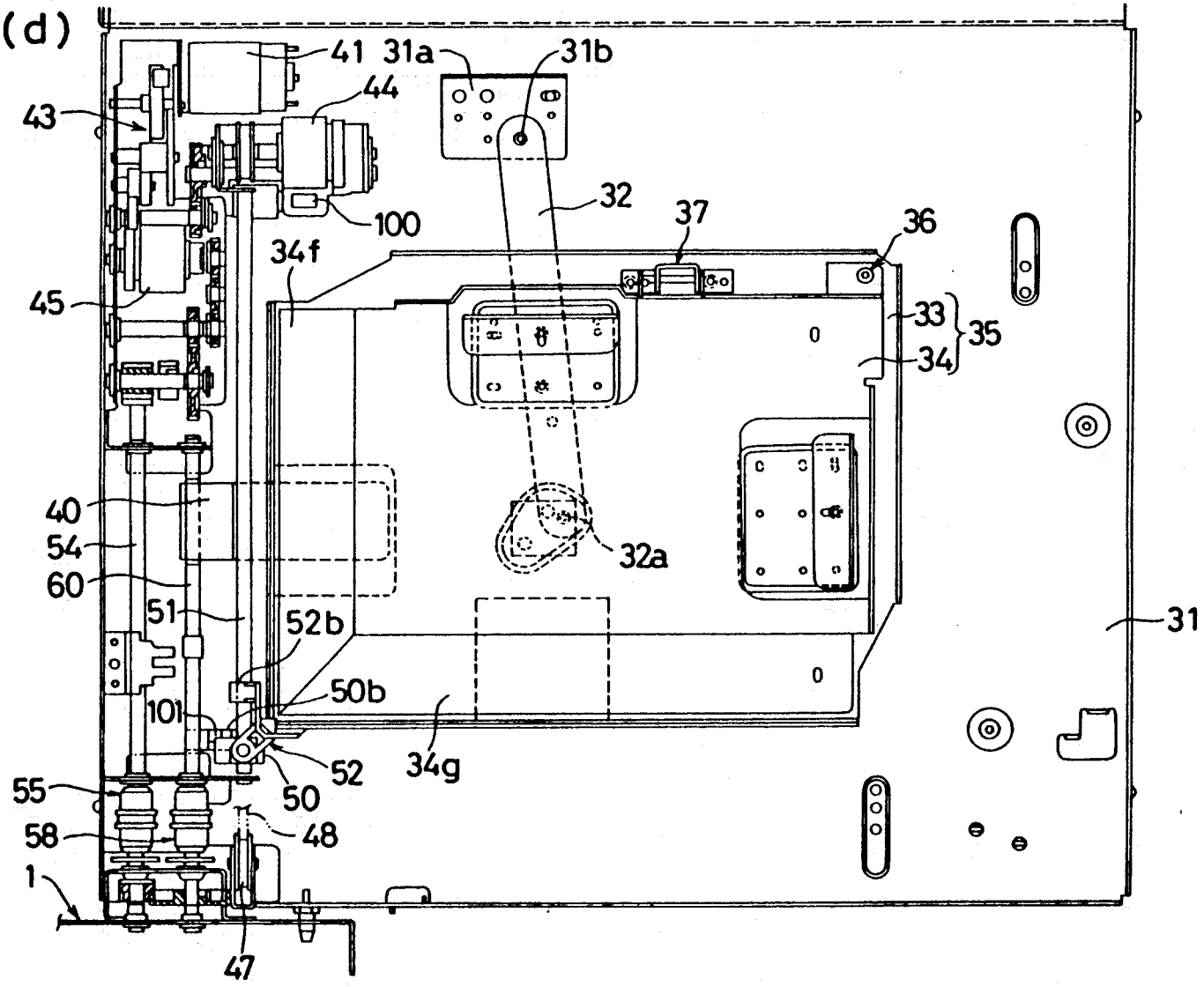

As shown in FIGS. 5(*a*) and 5(*b*), a mounting board 75 is installed under the paper feed roller 66. The mounting board 75 is provided with a reversing roller 74 for conveying a copy paper in the reverse direction as it rotates in the same direction as the rotation of the paper feed roller 66. The mounting board 75 pivots upward and downward whereby the reversing roller 74 is brought in contact with or is separated from the paper feed roller 66. A rotary shaft 74*a* for transmitting the rotary force to the reversing roller 74 is disposed under the rotary shaft 66*a* of the paper feed roller 66, being in parallel with the shaft 66*a*. An actuating segment 76*a* of the substantially L-shaped pressure contact releasing lever 76 is interposed between the rotary shafts 66*a* and 74*a*. The pressure contact releasing lever 76 pivots on the shaft 76*c* on a vertical plane and when the lever 76 pivots downward, the reversing roller 74 is pressed by the lever 76 so as to separate from the paper feed roller 66.

A connecting segment 76*b* of the pressure contact releasing lever 76 is connected to one end 77*a* of a pressure contact connecting/releasing member 77 and when the pressure contact connecting/releasing member 77 pivots on a shaft 77*c* (see FIG. 4), the pressure contact releasing lever 76 is rotated. The other end 77*b* of the pressure contact connecting/releasing member 77 is connected to a pin of an operation shaft 80*a* of a paper pushing back solenoid 80, and the operation shaft 80*a* moves forward and backward so that the pressure contact connecting/releasing member 77 is pivoted.

The operation shaft 80*a* of the paper pushing back solenoid 80 is connected to the paper pushing back member 81 for pushing a copy paper back toward the rotating section 35. The paper pushing back member 81 pivots on the shaft 81*a* on a vertical plane. The shaft 81*a* is interposed between the pick-up roller 65 and the paper feed roller 66, being at a higher position than the position of the pin of the operation shaft 80*a*. When the operation shaft 80*a* moves backward, the paper pushing back member 81 pivots such that a copy paper (not shown) is pushed back to the rotating section 35.

On the mounting board 63, a detection switch 82 is positioned at one side of the pick-up roller 65 and a paper detection switch 83 at the other side thereof. An actuating segment 82*a* of the detection switch 82 and an actuating segment 83*a* of the paper detection switch 83, respectively, extend downward from the mounting board 63 passing through the opening 63*a*. The actuating segment 82*a* of the detection switch 82 is pressed by the pivotal paper holding plate 34 when the plate 34 is raised, while the actuating segment 83*a* of the paper detection switch 83 is pressed by the copy papers stacked on the plate 34 when the plate 34 is raised. In the above arrangement, the pivotal paper holding plate 34 is provided with an opening (not shown) at the paper stacking position for longitudinal feed. The plate 34 is provided with another opening (not shown) at the paper stacking position for lateral feed. Therefore, when no paper is placed on the pivotal paper holding plate 34, the actuating segment 83*a* pierces the opening so that the paper detection switch 83 is not switched ON while the detection switch 82 is switched ON. On the other hand, when papers are placed on the pivotal paper holding plate 34, the detection switch 82 and the paper detection switch 83 are both switched ON.

Now, reference is made to FIGS. 6(*a*) through 6(*d*) for explaining the movement of the rotating section 35 when it moves from the lateral feed position to longitudinal feed position.

As shown in FIG. 6(*a*), when the rotating section 35 is in the lateral feed position, the wall portion 33*b* is in juxtaposition with the paper feeding end of the rotatable cassette 26 (or 27). In this condition, the moving block 50 and the holding member 52, which constitute the moving means, are positioned on one end of the guide shaft 51.

When the driving force of the driving motor 41 is transmitted to the pulley 46 via the first clutch 44, the pulley 46 is rotated thereby rotating the belt 48. Then, the moving block 50 fixed to the belt 48 is guided by the guide shaft 51 to move to the other end of the shaft 51.

As the moving block 50 linearly moves, the rotating section 35 is rotated in the direction indicated by the arrow A. Since the rotating section 35 is connected to the moving block 50 moves and the moving block 50 linearly, the center of the rotation of the rotating section 35 is moved. Such a movement is controlled by the arm 32 for pivotally supporting the rotating section 35. More specifically, the arm 32 rotates on the pivot pin 31 in the direction indicated by the arrow D, thereby ensuring the rotational movement of the rotating section 35. The rotation of the arm 32 in the direction indicated by the arrow D is carried out until the line X between the pivot pin 50*a* of the moving block 50 and the pivot pin 32*a* makes a right angle with the guide shaft 51.

As shown in FIG. 6(*c*), when the angle made by the line X with the guide shaft 51 exceeds 90°, the arm 32 starts to rotate in the direction indicated by the arrow C while the direction of rotation the rotating section 35 is unchanged. Thereafter, the moving block 50 comes to the other end of the guide shaft 51 as shown in FIG. 6(*d*), the position detection switch 101 is switched ON by the actuating segment 50*b* secured to the moving block 50. The control unit of the copying machine 1 detects the operation of the position detection switch 101, and then controls the first clutch 44 to suspend the transmission of the driving force, thereby halting the movement of the moving block 50. At that time, the wall portion 33*a* of the rotating section 35 is turned to be in juxtaposition with the paper feeding end of the rotatable cassette 26 (or 27).

The rotation of the rotating section 35 from the longitudinal feed position to the lateral feed position can be achieved by reversely rotating the driving motor 41 and carrying out the operations opposite to the foregoing procedures. When the rotating section 35 is set in the lateral feed position, the position detection switch 100 is switched ON by the switch actuating segment 52*b* of the holding member 52. The control unit of the copying machine 1 detects the operation of the position detection switch 100 and controls the first clutch 44 to suspend the transmission of the driving force, thereby halting the movement of the moving block 50.

The following description explains the operation for raising the paper feeding end of the pivotal paper holding plate 34. With the actuation of the second clutch 45, the driving force of the driving motor 41 is transmitted through the group of gears 53; the rotary shaft 54; the first coupling 55; the rotary shaft 56; the rotary shaft 57; the second coupling 58; and the lift-up shaft 60. The rotation of the lift-up shaft 60 causes the lift member 40 to be pivoted. After pivoting upward, the lift member 40 passes through the opening 33*c* of the paper feed base 33 and comes in contact with the bottom face of the pivotal paper holding plate 34, thereby raising the paper feeding end of the pivotal paper holding plate 34. After the pivotal paper holding plate 34 is raised, the paper feed mechanism 62 picks up the copy paper.

It is assumable that at the stage of the raising of the pivotal paper holding plate 34, the absence of copy paper may be detected by the paper detection switch 83 or a jam may occur in picking up a copy paper. In that case, the user takes out the rotatable cassette 26 or 27 from the main body of the copying machine 1. When the rotatable cassette 26 or 27 is taken out, the rotating section 35, driving motor 41, and the first and second clutches 44 and 45, which are all disposed within the cassette 26 (27), are taken out together with the cassette 26 (27), while the paper feed mechanism 62, and the rotary shafts 56 and 57 remain within the main body of the copying machine 1, as shown in FIG. 2. Since the rotary shafts 56 and 57 remain within the main body, the coupling part 55*a* is disengaged from the coupling part 55*b* in the first coupling 55 and the coupling part 58*a* is disengaged from the coupling part 58*b* in the second coupling 58, whereby the transmission of the driving force of the driving motor 41 to the lift member 40 is suspended. In cooperation with the above, the lift-up shaft 60 becomes free, and the lift member 40 is pivoted downward by its own weight, so that the pivotal paper holding plate 34 is released from its raised condition to be let down. With such an arrangement, even if the user is not aware that the pivotal paper holding plate 34 is in its raised condition and takes out the rotatable cassette 26 or 27 from the main body of the copying machine 1, the contact of the pivotal paper holding plate 34 and the paper feed mechanism 62 can be prevented since the plate 34 is lowered in cooperation with the cassette-taking-out action. As a result, damage to the contacted parts can be avoided.

In the foregoing embodiment, the coupling parts 55*a* and 58*a* are disengaged from the coupling parts 55*b* and 58*b* respectively, when the rotatable cassette unit 26 or 27 is drawn 6 mm from the main body for example. FIG. 2 shows a condition in which the cassette 26 or 27 is drawn 26 mm from the main body and the coupling parts 55*a*/55*b*, and 58*a*/58*b* are completely disengaged.

In the foregoing embodiment, the mechanism for raising/lowering the pivotal paper holding plate is adapted to a rotatable cassette, but the invention is not limited to this. For example, the mechanism may be adapted to a fixed cassette in a similar manner.

The feeding device according to the present invention comprises:

(1) a cassette detachable from the main body of a copying machine, comprising a pivotal paper holding plate capable of being raised;

(2) a lift member which is disposed under the pivotal paper holding plate and pivots on a vertical plane so as to raise the pivotal paper holding plate;

(3) a rotary lift-up member for allowing the lift member to pivot thereon, the lift member being secured to the rotary lift-up member;

(4) driving means for transmitting a driving force to the rotary lift-up member; and (5) coupling means included in the driving means, for effecting and suspending the transmission of the driving force for rotating the rotary lift-up member.

With such an arrangement, even if the cassette is taken out from the main body of the copying machine for supplying copy paper or settling a paper jam when the cassette is in a raised condition, the paper feeding end of the pivotal paper holding plate can be prevented from touching with the feeding mechanism provided within the main body of the copying machine so that damage to the contacted parts can be avoided, since the lift member is pivoted downward by its own weight in cooperation with the removal of the cassette and the pivotal paper holding plate is released from its raised condition.

The invention being thus described, it may be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A feeding device comprising:

a copy material feed unit removably mounted with respect to a main body of an apparatus to which the feeding device is adapted, said copy material feed unit including a pivotal copy material holding plate for holding copy material therein and capable of being raised;

a lift member, operatively connected to said copy material feed unit so as to be removable therewith, which lift member raises the pivotal copy material holding plate;

driving means, removable from the main body of the apparatus with said copy material feed unit, for providing a driving force to said lift member for raising the pivotal copy material holding plate until copy material placed thereon contacts a feeding mechanism within the main body of the apparatus;

a rotary shaft included in said driving means;

a lift-up shaft pivotally supporting said lift member; and coupling means including a first coupling portion connected to said rotary shaft and a second coupling portion connected to said lift-up shaft, wherein said coupling means completes a transfer of driving force from said rotary shaft to said lift-up shaft and removal of said copy material feed unit from said main body disengages said coupling means from said shafts, thereby disengaging the driving force to said lift member upon removal of the copy material feed unit and said driving means from the main body of the apparatus, thereby also releasing the copy material holding plate from its raised condition;

wherein said pivotal copy material holding plate does not contact the feeding mechanism when the copy material feed unit is mounted in and removed from the main body of the apparatus, thereby preventing mutual damage due to contacting each other.

2. A feeding device comprising:

a copy material feed unit removably mounted with respect to a main body of an apparatus to which the feeding device is adapted;

a pivotal copy material holding plate on which copy materials are stacked, the holding plate being installed within the copy material feed unit and capable of being raised to an inclined dispensing position;

a lift member, operatively connected to said copy material feed unit so as to be removable therewith, for raising the pivotal copy material holding plate to the inclined dispensing position, disposed under the pivotal copy material holding plate so as to pivot on a vertical plane;

a rotary lift-up member for allowing the lift member to pivot thereon, the lift member being secured to the rotary lift-up member;

driving means, removable from the main body of the apparatus with said copy material feed unit, for providing a driving force to the rotary lift-up member for raising the lift member and the pivotal copy material holding plate until copy material placed on the holding plate contacts a feeding mechanism within the main body of the apparatus; and coupling means included in the driving means, for selectively effecting and suspending the transmission of the driving force to the rotary lift-up member, said coupling means being engaged and disengaged from said rotary lift-up member in response to selective mounting and removal, respectively, of said copy material feed unit to and from the main body of the apparatus, wherein when the copy material feed unit is removed from the main body, the coupling means is disengaged and the lift member pivots downward due to its own weight, thereby terminating the transmission of driving force from said driving means to said rotary lift-up member and releasing the pivotal copy material holding plate form its inclined dispensing position and wherein said pivotal copy material holding plate does not contact the feeding mechanism from the main body of the apparatus thereby preventing mutual damage due to contacting each other.

3. The feeding device according to claim 2, wherein the copy material feed unit includes copy material orientation changing means which is rotatable to at least two feed positions, including a longitudinal feed position from which copy material longitudinally oriented with respect to a feed direction is fed and a lateral feed position from which copy material laterally oriented with respect to the feed direction is fed.

4. The feeding device according to claim 3, wherein the copy material orientation changing means includes at least two copy material stacking positions, including a longitudinal copy material stacking position on which copy materials are stacked for longitudinal feed and a lateral copy material stacking position on which copy materials are stacked for lateral feed.

5. The feeding device according to claim 4, wherein the copy material orientation changing means has a two-sheet structure consisting of a copy material feed base and the pivotal copy material holding plate positioned on the copy material feed base, and is rotated through 90° so as to change the orientation of the copy materials stacked thereon with respect to the feed direction.

6. The feeding device according to claim 5, further comprising guide means which includes (1) a sustaining member having a guide hole formed in a vertical direction; and (2) a guide member which engages with the guide hole, such that the pivotal copy material holding plate is guided by the guide means when the copy materials stacked on one of the copy material stacking positions of the pivotal copy material holding plate are raised up to the inclined dispensing position by said lift member, and the pivotal copy material holding plate pivots on the guide means when the copy material stacked on the other copy material stacking position are raised up to the inclined dispensing position by said lift member.

7. The feeding device according to claim 6, wherein the driving means comprises a single driving motor for driving the copy material orientation changing means so as to rotate through 90° and driving the pivotal copy material holding plate so as to pivot for raising up the copy material to the inclined dispensing position.

8. The feeding device according to claim 7, wherein the driving means comprises (1) a group of gears for transmitting the driving force of the driving motor; (2) a first clutch for effecting and suspending the transmission of the driving force through the group of gears, the driving force being utilized for rotating the copy material orientation changing means through 90°; and (3) a second clutch for effecting and suspending the transmission of the driving force toward the lift member, the driving force being utilized for raising up the copy materials stacked on the pivotal copy material holding plate to an inclined dispensing position.

9. The feeding device according to claim 8, wherein the driving means further comprises a rotary shaft for transmitting the driving force from the second clutch, the rotary shaft being connected to the coupling means.

10. The feeding device according to claim 9, wherein the coupling means disposed in the main body of the apparatus is connected to the group of gears which transmits the driving force from the rotary shaft to the rotary lift-up member so that the rotary lift-up member is rotated, causing the lift member to pivot.

11. The feeding device according to claim 10, wherein one end of the rotary lift-up member is secured to the coupling means while the other end thereof is pivotally held without a member connected thereto and the lift member is secured to the substantially central part of the rotary lift-up member, so that the feeding end of the pivotal copy material holding member is raised by the lift member when it pivots upward in cooperation with the rotation of the rotary lift-up member while the pivotal copy material holding member is released from its raised condition when the rotary lift-up member is disengaged from the coupling means, causing the lift member to pivot downward by its own weight.

12. The feeding device according to claim 2, wherein the copy material may be a copy paper used for a copying machine and laser printer, or a film used for an overhead projector.

13. The feeding device according to claim 2, wherein the copy material feed unit is a cassette for feeding copy material whose orientation with respect to the feed direction is not changed.

14. A feeding device comprising:

a cassette removably mounted in the main body of an apparatus to which the feeding device is adapted;

a pivotal paper holding plate which is disposed within the cassette and capable of being raised to an inclined dispensing position;

a lift member, operatively connected to and removable with said cassette, for raising the pivotal paper holding plate to the inclined dispensing position, disposed under the pivotal paper holding plate so as to pivot on a vertical plane;

a rotary lift-up member for allowing the lift member to pivot thereon, the lift member being secured to the rotary lift-up member;

driving means for providing a driving force to the rotary lift-up member for raising the lift member and the pivotal paper holding plate until the paper placed on the holding plate contacts a feeding mechanism within the main body of the apparatus; and coupling means included in the driving means, for effecting and suspending the transmission of the driving force for rotating the rotary lift-up member, wherein when the cassette is removed from the main body, said coupling means disengages from the rotary lift-up member thereby enabling the lift member to pivot downward due to its own weight, thereby releasing the pivotal paper holding plate from this raised condition and wherein said pivotal copy material holding plate does not contact the feeding mechanism when the cassette is mounted in and removed from the main body of the apparatus, thereby preventing mutual damage due to contacting each other.

* * * * *